US006461449B1

(12) United States Patent
Matsubara et al.

(10) Patent No.: US 6,461,449 B1
(45) Date of Patent: Oct. 8, 2002

(54) CONVERSION COATING ZINCIFEROUS SURFACES TO RESIST BLACKENING AND WHITE RUST

(75) Inventors: Yuzuru Matsubara, Hiratsuka; Akira Kato, Ichikawa, both of (JP)

(73) Assignee: Henkel Corporation, Gulph Mills, PA (US)

( * ) Notice: Subject to any disclaimer, the term of this patent is extended or adjusted under 35 U.S.C. 154(b) by 0 days.

(21) Appl. No.: 09/529,197

(22) PCT Filed: Oct. 7, 1998

(86) PCT No.: PCT/US98/20486

§ 371 (c)(1),
(2), (4) Date: Apr. 7, 2000

(87) PCT Pub. No.: WO99/18257

PCT Pub. Date: Apr. 15, 1999

(30) Foreign Application Priority Data

Oct. 7, 1997 (JP) ..... 9-290263

(51) Int. Cl.[7] ..... C23C 22/30; C23C 22/33

(52) U.S. Cl. ..... 148/258; 106/14.12; 106/14.21; 148/264; 148/267

(58) Field of Search ..... 106/14.12, 14.21; 148/258, 264, 267

(56) References Cited

U.S. PATENT DOCUMENTS

| | | | | |
|---|---|---|---|---|
| 4,812,175 | A | 3/1989 | Reghi | 148/258 |
| 4,963,198 | A | 10/1990 | Higgins | 148/267 |
| 4,966,634 | A | 10/1990 | Saeki et al. | 148/251 |
| 5,268,042 | A | 12/1993 | Carlson | 148/268 |

FOREIGN PATENT DOCUMENTS

| | | |
|---|---|---|
| JP | 63 171685 | 7/1988 |
| JP | 63 178873 | 7/1988 |
| JP | 95 006070 | 1/1995 |
| JP | 07 054156 | 2/1995 |
| SU | 539091 | 12/1976 |
| WO | 92 03594 | 3/1992 |
| WO | 94 02661 | 2/1994 |
| WO | 95 05247 | 2/1995 |

OTHER PUBLICATIONS

JP 59–177381—Oct. 8, 1984—Questel Orbit Accession No. 1984–285747[46]; Sec. Acc. no CPI: C1984–121504; Derwent Manual code: CPI: M13–A M13–B.

JP 05–331659—Dec. 14, 1993—Questel Orbit Accession No. 1994–023293[03]; Sec. Acc. no CPI: C1994–010906; Derwent Manual code: CPI: M14–D03.

JP 61–284581—Dec. 15, 1986—Questel Orbit Accession No. 1987–026699[04]; Sec. Acc. no C1987–026699[04]; Sec. Acc. no C1987–011462; Derwent Manual code: CPI: M14–D03 M14–K.

JP 63–218279—Sep. 12, 1998; Questel Orbit Accession No. 1988–297169[42]; Sec. Acc. no CPI: C1988–131843; Sec. Acc. no non–CPI: N1988–225440; Derwent Manual code CPI: M16–D03.

JP 63–307281—Dec. 14, 1988; Questel Orbit Accession No. 1989–034958[05]; Sec. Acc. no CPI: C1989–015272; Derwent Manual code: CPI: M14–D03.

JP 01–065272—Mar. 10 1989—Questel Orbit Accession No. 1989–11902[16]; Sec. Acc. no CPI: C1989–052889; Derwent Manual code: CPI: M14–D03.

JP 01–283382—Nov. 14, 1989—Questel Orbit Accession No. 1989–375751[51]; Sec. Acc. no CPI: C1989–166785; Derwent Manual code: CPI: M14–D03.

JP 91–066391—Oct. 17, 1991—Questel Orbit Accession No. 1988–358445[50]; Sec. Acc. no CPI: C1988–158693; Derwent Manual code: CPI: M14–D03.

JP 92–027297—May 11, 1992—Questel Orbit Accession No. 1990–136535[18]; Sec. Acc. no CPI: C1990–060174; Derwent Manual code: CPI: M14–D03.

JP 06–212445—Aug. 2, 1994—Questel Orbit Accession No. 1994–283753[35]; Sec. Acc. no CPI: C1994–129663; Derwent Manual code: CPI: M14–D03.

JP 74–031026—Aug. 17, 1974—Questel Orbit Accession No. 1974–65578V[37]; Derwent Manual code: CPI: A08–R A12–B04 G02–A05 M13–H05.

JP 74–040865—Nov. 6, 1974—Questel Orbit Accession No. 1974–83710V[48]; Derwent Manual code: CPI: A04–B03 A04–B05 A04–C04 A A04–D04 A04–F01 A12–B04A M13–H05.

JP 50–057931—May 20, 1975—Questel Orbit Accession No. 1975–12756W[08]; Derwent Manual code: CPI: A05–E08 A12–B04A G02–05 M13–H05 M14–D.

JP 05–279867—Oct. 26, 1993—Questel Orbit Accession No. 1993–374973[47]; Sec. Acc. no CPI: C1993–166637; Derwent Manual code: CPI: A05–H01B A06–A00E A12–W12E M14–D03.

JP 06–192850—Jul. 12, 1994—Questel Orbit Accession No. 1994–260945[32]; Sec. Acc. no CPI: C1994–119560; Derwent Manual code: CPI: A05–G01E1 A12–B04C A12–S09 G02–A05E M14–D03.

*Primary Examiner*—Anthony Green
(74) *Attorney, Agent, or Firm*—Stephen D. Harper; Daniel S. Ortiz

(57) ABSTRACT

Metal surfaces, particularly the zinciferous surfaces of zinc-coated steel, can be given a chromate conversion coating that is superior in terms of blackening resistance and white rust resistance by drying into place on the surfaces a layer of a treatment liquid that contains water, hexavalent chromium atoms, trivalent chromium cations, nitrate ions and one or more types of metal ions selected from the group consisting of Ni, Co, Zn and Al, the molar ratio of the total of these metal ions to nitrate ions being in the range from 0.05 to 1.0, the molar ratio of trivalent chromium ions to hexavalent chromium atoms being in the range of 0.11:1.0 to 1.0:1.0, and the molar ratio of nitrate ions to total chromium atoms being in the range of 2.1 to 5.5. Preferably, the coating formed has a chromium content of 10 to 100 mg/m$^2$.

14 Claims, No Drawings

CONVERSION COATING ZINCIFEROUS SURFACES TO RESIST BLACKENING AND WHITE RUST

BACKGROUND OF THE INVENTION

The present invention concerns a composition and method for conversion coating a zinciferous surface, without any need for a preparatory flash treatment using Ni or Co, or the like, to make the zinciferous surface superior in its resistance to blackening and white rust. For this purpose, a zinciferous surface includes a surface of pure zinc, any zinc alloy that includes at least 50% by weight of zinc, and any alloy of zinc and aluminum that includes up to 55% aluminum. The invention is particularly advantageously used on zinc plated steel sheet such as is commonly made by depositing a zinciferous surface on a steel substrate by electrolysis or by coating the substrate with molten zinc or zinc alloy. The invention will be further described hereinafter in terms of its use on zinc-plated steel sheet, but it should be understood to be applicable, mutatis mutandis, to other zinciferous surfaces.

Sacrificial anti-corrosion protection of steel by means of zinc plating is highly effective and economical; currently, therefore, about 10,000,000 tons of steel, corresponding to 10% of the annual crude steel production of about 100,000,000 tons in Japan, is produced as zinc-plated steel sheets, and such sheets are used in a wide variety of fields such as construction materials, automobiles and home electrical appliances, etc. Sacrificial anti-corrosion protection by means of zinc is believed to operate as follows: an electrochemical cell is formed under conditions in which the two metals (zinc and steel) are in contact, with zinc, the baser of the two metals, acting as an anode, and iron acting as a cathode. By this means, anodic dissolution of iron caused by local cell formation when iron alone is exposed to a corrosive environment is suppressed, thus preventing corrosion of the steel. Accordingly, anti-rust effectiveness of the iron and zinc combination ends at the point in time when the zinc in contact with the steel is consumed, so that corrosion of the zinc layer must be suppressed in order to obtain an enduring protective effect from the zinciferous coating. The prior art means used to achieve this is a chromate treatment of the zinciferous surface following plating.

However, in the case of rust-proofing methods using a chromate treatment on zinc-plated steel sheets, the following problems arise: Although the generation of white rust is very effectively prevented by subjecting zinc-plated steel sheets to a chromate treatment, the plated surface is still blackened by the generation of black rust in a relatively short time in cases where the sheets are stored in a coiled state or in cases where the sheets are applied to roofs or walls, etc. (this is also referred to as, the phenomenon of "blackening"). It has been recognized that this phenomenon occurs more readily in steel sheets in which the plating surface has been activated by skin pass rolling following zinc plating, and in steel sheets plated with a molten zinc-aluminum alloy containing several % aluminum.

To avoid the problem of blackening following chromate treatment, a flash treatment (this refers to a treatment in which an extremely small amount of a metal is chemically deposited; see further below) using an aqueous solution which contains metal ions of Ni or Co as taught in Japanese Patent Application Kokai No. SHO59-177381 is currently viewed as being a powerful countermeasure. Specifically, the gist of the invention in the aforementioned patent is that prior to the chromate treatment of a steel plate plated with zinc or a zinc alloy, the surface of the steel sheet is subjected to a flash treatment using an aqueous solution which has a pH of 1 to 4 or 11 to 13.5, and which contains metal ions of Ni or Co, or both, as a means of suppressing the above-mentioned black rust. In this case, after the aforementioned metal ions have been is deposited in the form of a metal or oxide, the sheet is washed with water, after which a chromate coating film is formed. However, when such a flash treatment is performed prior to a chromate treatment, although black rust is inhibited, white rust tends to be generated.

Japanese Patent Application Kokai No. HEI 5-331659 and Japanese Patent Application Kokai No. HEI 7-54156 teach methods which can simultaneously suppress both blackening and the generation of white rust by means of a single process consisting only of a chromate treatment, without any need for a two-process treatment consisting of a preparatory flash treatment and a chromate treatment. However, user needs in recent years have required highly stable resistance to blackening and resistance to white rust over a longer period of time regardless of variation in the activity of the plated surface, and such requirements cannot be satisfied using the above-mentioned conventional techniques.

The problems which the present invention attempts to solve are one or more of the above-mentioned problems in the prior art. The object of the present invention is therefore to provide to zinc-plated steel sheets a high resistance to blackening and white rust over a long period of time, regardless of any variation in the activity of the plated surface of the zinc-plated steel sheet.

BRIEF SUMMARY OF THE INVENTION

The object of the invention is achieved by an aqueous conversion coating forming liquid treatment composition that has both of the following properties (A) and (B):

(A) the composition comprises, preferably consists essentially of, or more preferably consists of water and the following components:
- (A.1) dissolved ions and/or molecules that contain hexavalent chromium atoms;
- (A.2) dissolved trivalent chromium cations;
- (A.3) dissolved nitrate ions; and
- (A.4) dissolved cations of one or more metals selected from the group consisting of Ni, Co, Zn and Al;

and, optionally, one or more of the following components:
- (A.5) dissolved phosphate ions;
- (A.6) dissolved fluoride ions;
- (A.7) dispersed silica and/or dispersed and/or dissolved silicates; and
- (A.8) dispersed and/or dissolved polymer resins; and (B) in the liquid treatment composition:
- (B.1) the molar ratio of dissolved trivalent chromium ions to hexavalent chromium atoms is in a range from 0.11:1.0 to 1.0:1.0;
- (B.2) the molar ratio of nitrate ions to total chromium atoms (i.e., the sum of hexavalent chromium atoms and trivalent chromium cations) is in a range from 2.1:1.0 to 5.5:1.0;
- (B.3) the molar ratio of the total of dissolved metal cations that are selected from the group consisting of Ni, Co, Zn and Al to nitrate ions is in a range from 0.05:1.0 to 1.0:1.0;
- (B.4) the molar ratio of dissolved phosphate ions[1] to total chromium atoms is not more than 0.3:1.0; and
- (B.5) the molar ratio of dissolved fluoride ions[1] to total chromium ions is not more than 0.1:1.0.

[1]If the concentration of these ions is so small that it can not easily be measured, the ratio assumed to be 0.0:1.0.

A process according to the invention comprises an operation in which a liquid film of a treatment composition as described immediately above is formed over a zinciferous substrate and then dried, thus forming an adherent dry coating with a chromium content of 10 to 100 milligrams of chromium per square meter of surface coated, this unit of areal density or coating weight being hereinafter usually abbreviated as "$mg/m^2$".

DETAILED DESCRIPTION OF THE INVENTION AND PREFERRED EMBODIMENTS

The molar ratio of trivalent chromium ions to hexavalent chromium ions contained in a chromate containing treatment solution used in the present invention is preferably in the range of 0.25:1.0 to 0.67:1.0. If the molar ratio of trivalent chromium ions to hexavalent chromium atoms is less than 0.11:1.0, the elution of chromium ions in a corrosive environment is excessive, leading to environmental contamination, which is undesirable. On the other hand, if the molar ratio of trivalent chromium ions to hexavalent chromium atoms exceeds 1.0:1.0, the corrosion resistance of the treated substrate is insufficient; this is also undesirable.

The preferred source of dissolved hexavalent chromium atoms for a treatment composition according to the invention is the material known variously as chromic acid, chromic anhydride, and chromium trioxide, with the chemical formula $CrO_3$. If more of it is added to the composition than corresponds to the desired concentration of hexavalent chromium atoms, it may be partially reduced to provide at least some of the trivalent chromium cations. Alternatively or concurrently, these latter cations may be provided to the treatment composition by water soluble salts such as chromium nitrate. The nitrate ions may be provided by addition of nitric acid, chromium nitrate, or nitric acid salts of the metal ions selected from the group consisting of Ni, Co, Zn and Al.

If the molar ratio of nitrate ions to total chromium atoms is less than 2.1:1.0, the concentration of nitrate ions is insufficient to obtain a highly stable resistance to blackening over a long period of time. On the other hand, in cases where the molar ratio of nitrate ions to total chromium atoms exceeds 5.5:1.0, the etching rate becomes higher than desirable, so that the oxide layer on the plated surface is rapidly dissolved, leading to activation of the surface. In addition, elution of the resulting chromate coating film in a corrosive environment becomes excessive, so that the resistance to white rust drops; this is undesirable.

The required Ni, Co, Zn, and/or Al ions may be supplied to the treatment composition by any soluble salt of these metal ions. Preferred sources include nitrates, basic carbonates, phosphates, oxides and hydroxides. If the molar ratio of metal ions to nitrate ions is less than 0.05, the pH of the chromate solution will become excessively low, so that the plated surface will be activated to a greater extent than is necessary as a result of contact of the liquid with the zinc-plated steel sheets. As a result, not only is there inadequate inhibition of blackening and the generation of white rust, but components of the zinciferous surface become admixed with the chromate solution as a result of an increase in the etching rate, so that a sludge tends to be created; this is undesirable. Furthermore, in cases where the molar ratio of metal ions to nitrate ions exceeds 1.0:1.0, precipitation tends to occur in the chromate solution, so that the solution stability drops; this is undesirable. By keeping the molar ratio of the metal ions to the nitrate ions in the treatment solution at a ratio in the range of 0.05:1.0 to 1.0:1.0, the effectiveness of the chromate treatment solution can be stably maintained even in the case of long-term use involving continuous operation, so that a stable coating film performance can also be insured.

By including phosphate ions and/or fluoride ions in the treatment solution of the present invention, it is possible to achieve a further improvement in the chromium leaching resistance and white rust resistance of the chromate coating film. If the molar ratio of phosphate ions to total chromium atoms exceeds 0.3, the chromium leaching resistance is improved, but the resistance to blackening deteriorates. The fluoride ions may be supplied as simple or complexed fluorides from any water soluble source, but preferably are supplied by means of hexafluorosilicic acid, tetrafluoroboric acid, hexafluorotitanic acid, hexafluorozirconic acid, and/or one or more salts of all of these acids that contain complexed fluoride ions. If the molar ratio of fluoride ions to total chromium atoms exceeds 0.1, the chromium leaching resistance is increased, but the resistance to blackening deteriorates.

A treatment solution of the present invention may contain (if necessary or desirable) colloidal silica preparations such as silica sols or fumed silica, etc., which have been disclosed in large numbers in the past in Japanese Patent Application Kokoku No. SHO 42-14050, Japanese Patent Application Kokoku No. SHO 61-58522, Japanese Patent Application Kokai No. SHO 61-284581, Japanese Patent Application Kokai No. SHO 63-218279, Japanese Patent Application Kokai No. SHO 63-307281, Japanese Patent Application Kokai No. SHO 64-65272, Japanese Patent Application Kokai No. HEI 1-283382, Japanese Patent Application Kokoku No. HEI 3-66391, Japanese Patent Application Kokoku No. HEI 3-68115, Japanese Patent Application Kokoku No. HEI 4-20992, Japanese Patent Application Kokoku No. HEI 4-27297 and Japanese Patent Application Kokai No. HEI 6-212445, etc., and/or resin emulsions and/or water-soluble resins which have been disclosed in large numbers in Japanese Patent Application Kokoku No. 49-31026, Japanese Patent Application Kokoku No. SHO 49-40865, Japanese Patent Application Kokoku No. SHO 50-31026, Japanese Patent Application Kokai No. SHO 50-57931, Japanese Patent Application Kokoku No. HEI 7-6070, Japanese Patent Application Kokai No. HEI 5-279867 and Japanese Patent Application Kokai No. HEI 6-192850, etc.

A dry chromate conversion coating is formed by applying a layer of a liquid coating composition according to the invention as described above to the surface of the zinc-plated steel sheet, and then drying the applied solution without washing with water.

It is desirable that the layer of coating film applied, and therefore the dried conversion coating obtained, should contain from 10 to 100 $mg/m^2$ of chromium. If the amount of chromium in the conversion coating is less than 10 $mg/m^2$, the corrosion resistance will usually be insufficient. On the other hand, if the amount of chromium in the coating exceeds 100 $mg/m^2$, the corrosion resistance will not further improve, so that the use of such an amount is uneconomical.

After the treatment composition has been applied to the object of treatment, for example by a spray method or an immersion treatment method, so that the liquid is caused to contact the surface of the plated steel sheet, any excess of the treatment composition may be removed by means of passing between suitably spaced rolls, use of an air knife, or the like;

alternatively, a controlled amount of the treatment solution may been applied by means of a roll coater, curtain coater, or the like. In either instance, a chromate coating film is formed by drying the layer of the treatment composition by means of a heating method such as heated air, infrared radiation, far infrared radiation or induction heating, etc., without any washing with water. The drying conditions used are such that the moisture content of the coating film is evaporated; ordinarily, the maximum temperature attained is in the range of 40 to 250° C.

The composition and method according to this invention make it possible to provide zinc-plated steel sheets that simultaneously satisfy requirements for highly stable blackening resistance and white rust resistance over a long period of time; this could not be achieved using prior art techniques.

The invention and its advantages may be further appreciated by consideration of the following working examples and comparative examples, which are used to illustrate the invention, without limiting it in any way.

GENERAL CHARACTERISTICS OF THE EXAMPLES

In the respective working examples and comparative examples, the test sheets described below were subjected to alkali degreasing, water washing and drying as described in numbered items (2) through (4) below, and were then subjected to a chromate treatment by the processes described in numbered items (5) and (6) below. Furthermore, the respective treated test sheets were subjected to a chromium leaching resistance as described in numbered item (7) below and to an accelerated blackening test and an accelerated white rust test as described in paragraphs (8) and (9) below.

(1) Test substrates: zinc-coated steel sheets steel sheets hot-dipped in molten zinc steel sheets hot-dipped in molten zinc-5% aluminum alloy steel sheets hot-dipped in molten zinc-55% aluminum alloy (2) Alkali degreasing with a weakly alkaline degreasing agent (PALKLIN® 342 concentrate manufactured by Nihon Parkerizing Co., Ltd., 2% aqueous solution, temperature 60° C., 10 second spray)

(3) Washing: spray-washing with tap water, 22±5° C., 10 seconds (4) Drying: forced air drying (5) Chromate treatment: the amount of chromate coating film was controlled by the wet coating amount applied by roll coating (6) Drying: maximum temperature reached=70° C., except 150° C. for the coating with a resin content; drying time: 5 seconds.

(7) Chromium leaching resistance test:

The zinc-plated steel sheets which had been subjected to a chromate treatment were subjected to alkaline leaching under the conditions described below. The amounts of adhering chromium before and after leaching were measured by means of a fluorescent X-ray analyzer, and the chromium leaching resistance was calculated using the formula shown below. A larger percent value indicates a superior chromium leaching resistance.

Alkaline leaching was accomplished by a 2 minute spray treatment at 60° C. using a 2% aqueous solution of an alkaline degreasing agent (PALKLIN® N364S manufactured by Nihon Parkerizing Co., Ltd.).

Chromium leaching resistance=$(A/A_0)\times 100$ (%), where A represents the amount of chromium coating film in mg/m$^2$ following alkaline leaching and $A_0$ represents the amount of chromium coating film in mg/m$^2$ before alkaline leaching.

(8) Accelerated black rust test:

70 mm×150 mm test samples from the respective test sheets were arranged as facing pairs, and 5 to 10 of these pairs were stacked and wrapped in vinyl-coated paper. This stack was then compressed between two rectangular strong metal plates with a bolt hole in each of their four corners, and a load of 70 kilograms force-centimeters was applied with a torque wrench to the nuts on the bolts holding the two plates together. Then, after being held for 360 hours in a humidity cabinet at a temperature of 70° C. and a relative humidity of 80%, the samples were removed, and the conditions of blackening in the overlapping parts were ascertained by visual inspection. The evaluation criteria used were as follows:

++: No blackening

+: Extremely light graying

Δ: Less than 25% blackening

×: 25% blackening or greater (9) Accelerated white rust test:

70 mm×150 mm test samples were cut from the respective test sheets, and the aforementioned test sheets were subjected to a salt spray test as stipulated in Japanese Industrial Standard ("JIS")-Z2371. The surface area of white rust generation was then ascertained by visual inspection after 120 hours in the case of steel sheets plated with molten zinc, after 360 hours in the case of steel sheets plated with molten zinc—5% aluminum alloy, and after 720 hours in the case of steel sheets plated with molten zinc—55% aluminum alloy. The evaluation criteria used were as shown below:

++: no white rust

+: less than 5% surface area showing white rust

Δ: 5% or more but less than 25% surface area showing white rust

×: 25% or more surface area showing white rust

The conversion coating treatment compositions are detailed in Table 1, and the amount of chromium in the conversion coatings formed, chromium leaching resistance, and results of the accelerated blackening test and accelerated white rust test are shown in Tables 2 through 4. As is shown in these Tables, when treating any of the substrates with compositions according to the invention, it is possible to improve the resistance to blackening and the resistance to white rust with good balance in terms of high stability over a long period of time, even without performing a metal flash treatment. Accordingly, a single-process treatment may be performed instead of a two-process treatment in which a chromate treatment is performed following a pretreatment. Furthermore, since the amount of etching of the material is limited, it is clear that industrially useful effects such as superior continuous-operation characteristics can be obtained.

In contrast, two of the chromate treatments described in Japanese Patent Application Kokai No. HEI 7-54156, which are shown in Table 1 as Comparative Examples 3 and 4 are insufficient for obtaining a blackening resistance that is highly stable over a long period of time. With the composition of Comparative Example 2, a slight effect on blackening resistance is seen, but the white rust resistance is still inferior.

TABLE 1

CONVERSION COATING COMPOSITIONS USED

| Identification | Characteristics of the Compositions | | | | | | |
|---|---|---|---|---|---|---|---|
| | Cr(III)/ Cr(VI) | Nitrate/ Total Cr | Additional Metal Cations Source | Additional Metal/ Nitrate | Phosphate/ Total Cr | Fluoride Source | Fluoride/ Total Cr |
| Ex. 1 | 1/9 | 4.6 | $3NiCO_3.Ni(OH)_2.20H_2O$ | 0.60 | 0.3 | — | — |
| Ex. 2 | 1/3 | 3.6 | $Ni(NO_3)_2.6H_2O$ | 0.50 | — | — | — |
| Ex. 3 | 1/2 | 5.5 | $Zn(NO_3)_2.6H_2O$ | 0.49 | — | — | — |
| Ex. 4 | 1/1 | 4.2 | $Co(NO_3)_2.6H_2O$ | 0.50 | 0.1 | $H_2ZrF_6$ | 0.1 |
| Ex. 5 | 1/2 | 4.0 | $Al(OH)_3$ | 0.20 | — | — | — |
| Ex. 6 | 1/2 | 4.4 | $Ni(NO_3)_2.6H_2O$ + $Co(NO_3)_2.6H_2O$ | 0.50 | 0.1 | — | — |
| Ex. 7[1] | 1/2 | 4.4 | $Ni(NO_3)_2.6H_2O$ | 0.50 | — | — | — |
| Ex. 8[2] | 1/2 | 3.0 | $Ni(NO_3)_2.6H_2O$ | 0.50 | 0.1 | — | — |
| CE 1 | 1/2 | — | — | — | — | — | — |
| CE 2 | 1/1 | 1.8 | — | — | — | — | — |
| CE 3 | 1/2 | 0.4 | $Co(NO_3)_2.6H_2O$ | 0.50 | — | — | — |
| CE 4 | 1/2 | 1.0 | $Co(NO_3)_2.6H_2O$ | 0.50 | 0.1 | — | — |

Footnotes for Table 1

[1]This composition also contained colloidal silica (SNOWTEX ™ O manufactured by Nissan Kagaku) in an amount with a ratio to total chromium atoms by weight of 4.

[2]This composition also contained an acrylic resin emulsion (manufactured by Hekisuto Gosei), a copolymer of methyl methacrylate and butyl acrylate with a molecular weight of 200,000 or greater, emulsified with polyoxyethylene alkylphenyl ether and alkylbenzenesulfonates in an amount such that the ratio by weight of resin solids to total chromium atoms was 20.

Abbreviations for Table 1

"Ex." means "Example according to the invention";

"CE" means "Comparison Example;

"—" means "none" or "zero" as appropriate.

TABLE 2

TEST RESULTS ON HOT-DIPPED GALVANIZED STEEL SUBSTRATES

| Composition Identification | Test Result, After Treatment with This Composition, for: | | | |
|---|---|---|---|---|
| | $mg/m^2$ of Cr in the Coating | Chromium Leach Resistsnce, % | Blackening Test Rating | White Rust Test Rating |
| Ex.1 | 11 | 72 | ++ | ++ |
| Ex.2 | 12 | 75 | ++ | ++ |
| Ex.3 | 15 | 80 | ++ | ++ |
| Ex.4 | 13 | 75 | ++ | ++ |
| Ex.5 | 12 | 80 | ++ | ++ |
| Ex.6 | 25 | 82 | ++ | ++ |
| Ex.7 | 13 | 85 | ++ | ++ |
| Ex.8 | 25 | 85 | ++ | ++ |
| CE 1 | 15 | 55 | X | X |
| CE 2 | 13 | 91 | + | X |
| CE 3 | 12 | 73 | + | Δ |
| CE 4 | 26 | 75 | + | + |

TABLE 3

TEST RESULTS ON STEEL SUBSTRATE HOT-DIPPED IN ZN-5% AL ALLOY

| Composition Identification | Test Result, After Treatment with This Composition, for: | | | |
|---|---|---|---|---|
| | $mg/m^2$ of Cr in the Coating | Chromium Leach Resistsnce, % | Blackening Test Rating | White Rust Test Rating |
| Ex.1 | 22 | 74 | ++ | ++ |
| Ex.2 | 24 | 72 | ++ | ++ |
| Ex.3 | 25 | 82 | ++ | ++ |
| Ex.4 | 26 | 73 | ++ | ++ |
| Ex.5 | 23 | 81 | ++ | ++ |

TABLE 3-continued

TEST RESULTS ON STEEL SUBSTRATE HOT-DIPPED IN ZN-5% AL ALLOY

| Composition Identification | Test Result, After Treatment with This Composition, for: | | | |
|---|---|---|---|---|
| | $mg/m^2$ of Cr in the Coating | Chromium Leach Resistsnce, % | Blackening Test Rating | White Rust Test Rating |
| Ex.6 | 51 | 79 | ++ | ++ |
| Ex.7 | 25 | 88 | ++ | ++ |
| Ex.8 | 48 | 85 | ++ | ++ |
| CE 1 | 26 | 58 | X | X |
| CE 2 | 25 | 89 | + | X |
| CE 3 | 26 | 70 | Δ | Δ |
| CE 4 | 48 | 75 | Δ | + |

TABLE 4

TEST RESULTS ON STEEL SUBSTRATE HOT-DIPPED IN ZN-5% AL ALLOY

| Composition Identification | Test Result, After Treatment with This Composition, for: | | | |
|---|---|---|---|---|
| | $mg/m^2$ of Cr in the Coating | Chromium Leach Resistsnce, % | Blackening Test Rating | White Rust Test Rating |
| Ex.1 | 43 | 70 | ++ | ++ |
| Ex.2 | 42 | 72 | ++ | ++ |
| Ex.3 | 45 | 79 | ++ | ++ |
| Ex.4 | 45 | 70 | ++ | ++ |
| Ex.5 | 43 | 77 | ++ | ++ |
| Ex.6 | 75 | 75 | ++ | ++ |
| Ex.7 | 40 | 85 | ++ | ++ |
| Ex.8 | 50 | 85 | ++ | ++ |
| CE 1 | 42 | 55 | X | X |
| CE 2 | 41 | 81 | Δ | X |

TABLE 4-continued

TEST RESULTS ON STEEL SUBSTRATE HOT-DIPPED IN ZN-5% AL ALLOY

| Composition Identification | Test Result, After Treatment with This Composition, for: mg/m$^2$ of Cr in the Coating | Chromium Leach Resistsnce, % | Blackening Test Rating | White Rust Test Rating |
|---|---|---|---|---|
| CE 3 | 43 | 72 | Δ | Δ |
| CE 4 | 41 | 72 | Δ | Δ |

What is claimed is:

1. A liquid composition of matter suitable for forming a chromium containing conversion coating on a metal surface when contacted therewith, said composition having both of the following properties (A) and (B):

(A) the composition comprises water and the following components:

(A.1) dissolved ions and/or molecules that contain hexavalent chromium atoms;

(A.2) dissolved trivalent chromium cations;

(A.3) dissolved nitrate ions;

(A.4) dissolved cations of one or more metals selected from the group consisting of Ni, Co, Zn and Al; and (A.5) dissolved phosphate ions; and (B) in the liquid treatment composition:

(B.1) a molar ratio of dissolved trivalent chromium ions to hexavalent chromium atoms is in a range from 0.11:1.0 to 1.0:1.0;

(B.2) a molar ratio of nitrate ions to a sum of hexavalent chromium atoms and trivalent chromium cations is in a range from 2.1:1.0 to 5.5.:1.0;

(B.3) a molar ratio of the total of dissolved metal cations selected from the group consisting of Ni, Co, Zn and At to nitrate ions is in a range from 0.05:1.0 to 1.0:1.0;

(B.4) a molar ratio of dissolved phosphate ions to a sum of hexavalent chromium atoms and trivalent chromium cations is not more than 0.3:1.

2. A composition according to claim 1, wherein the molar ratio of trivalent chromium cations to hexavalent chromium atoms is from 0.25 to 0.67:1.0.

3. A composition according to claim 2, which additionally comprises dissolved fluorine containing anions in an amount such that the molar ratio of dissolved fluoride ions to total chromium ions is not more than 0.1:1.0.

4. A composition according to claim 1, which additionally comprises dissolved fluorine containing anions in an amount such that the molar ratio of dissolved fluoride ions to total chromium ions is not more than 0.1:1.0

5. A composition according to claim 4, wherein the dissolved fluorine containing anions have been supplied to the composition by dissolving therein at least one of hexafluorosilicic acid, tetrafluoroboric acid, hexafluorotitanic acid, hexafluorozirconic acid, hexafluorosilicic acid salts, tetrafluoroboric acid salt, hexafluorotitanic acid salts, and hexafluorozirconic acid salts.

6. A composition according to claim 3, wherein the dissolved fluorine containing anions have been supplied to the composition by dissolving therein at least one of hexafluorosilicic acid, tetrafluorobonic acid, hexafluorotitanic acid, hexafluorozirconic acid, hexafluorosilicic acid salts, tetrafluoroboric acid salts, hexafluorotitanic acid salts, and hexafluorozirconic acid salts.

7. A method for forming a conversion coating on a metal surface, said method comprising the operations of:

(I) forming over the metal surface to be coated a liquid layer of a composition according to claim 3; and, without any intermediate rinsing, (II) drying into place on the surface the liquid layer formed in operation (I).

8. A method according to claim 7, wherein the amount of chromium retained in the conversion coating formed by the acid of operation (II) is form 10 to 100 milligrams of chromium per square meter of coating formed.

9. A method according to claim 8, where the metal surface coated is a zinciferous surface of zinc-coated steel sheet.

10. A method according to claim 7, where the metal surface coated is a zinciferous surface of zinc-coated steel sheet.

11. A method for forming a conversion coating on a metal surface, said method comprising the operations of:

(I) forming over the metal surface to be coated a liquid layer of a composition according to claim 1; and, without any intermediate rinsing, (II) drying into place on the surface the liquid layer formed in operation (I).

12. A method according to claim 11, wherein the amount of chromium retained in the conversion coating formed by the end of operation (II) is from 10 to 100 milligrams of chromium per square meter of coating formed.

13. A method according to claim 12, where the metal surface coated is a zinciferous surface of zinc-coated steel sheet.

14. A method according to claim 11, where the metal surface coated is a zinciferous surface of zinc-coated steel sheet.

* * * * *